US006634681B1

(12) United States Patent
Redden

(10) Patent No.: US 6,634,681 B1
(45) Date of Patent: Oct. 21, 2003

(54) SECURITY BAR RELEASE MECHANISM

(75) Inventor: Warren C. Redden, Gypsum, KS (US)

(73) Assignee: Exit Technologies, Inc., Gypsum, KS (US)

( * ) Notice: Subject to any disclaimer, the term of this patent is extended or adjusted under 35 U.S.C. 154(b) by 0 days.

(21) Appl. No.: 09/979,871

(22) PCT Filed: May 2, 2000

(86) PCT No.: PCT/US00/12054

§ 371 (c)(1),
(2), (4) Date: Nov. 27, 2001

(87) PCT Pub. No.: WO00/73607

PCT Pub. Date: Dec. 7, 2000

Related U.S. Application Data

(60) Provisional application No. 60/136,486, filed on May 28, 1999.

(51) Int. Cl.[7] ..... E05B 15/02; E05B 65/10

(52) U.S. Cl. ..... 292/92; 49/141; 49/56; 292/341.15

(58) Field of Search ..... 292/92, 93, 302, 292/341.15, DIG. 16, DIG. 65, 259 R; 70/257; 49/50, 56, 141

(56) References Cited

U.S. PATENT DOCUMENTS

| | | | | |
|---|---|---|---|---|
| 1,618,617 A | | 2/1927 | Whitney | |
| 1,882,339 A | * | 10/1932 | Richards | |
| 2,373,783 A | * | 4/1945 | Schlifer | 70/101 |
| 3,777,098 A | | 12/1973 | Tapper | 219/10.55 |
| 4,057,935 A | | 11/1977 | Rohrberg et al. | 49/56 |
| 4,127,966 A | | 12/1978 | Schmidt | 49/141 |
| 4,261,606 A | | 4/1981 | Cornelius et al. | 292/258 |
| 4,263,747 A | | 4/1981 | Coltrin et al. | 49/56 |
| 4,730,513 A | | 3/1988 | Heinrich et al. | 74/625 |
| 4,856,229 A | | 8/1989 | Tserng | 49/56 |
| 4,897,961 A | | 2/1990 | Shine | 49/141 |
| 5,007,200 A | | 4/1991 | Londono | 49/141 |
| 5,018,302 A | | 5/1991 | Kluge | 49/56 |
| 5,862,570 A | | 1/1999 | Lezuch et al. | 16/82 |

* cited by examiner

*Primary Examiner*—Gary Estremsky
(74) *Attorney, Agent, or Firm*—Westman, Champlin & Kelly, P.A.

(57) ABSTRACT

A lock mechanism for releasably locking a security bar (14) over an opening (12) through a wall (10) includes a housing (30, 32, 60) for mounting to the wall adjacent the opening. An engagement mechanism (28) is coupled to the security bar (14). A keeper member (26) in the housing is movable to selectively engage a lock surface (102) on the engagement mechanism to restrain the engagement mechanism from movement relative to the housing; the engagement mechanism being allowed to move unrestrained relative to the housing when the keeper member does not engage the lock surface. A manually-operable latch mechanism (24) in the housing moves the keeper member out of engagement with the lock surface. A receiver tube (70) forms a passage between the housing and the outside surface of the wall, with the engagement mechanism (28) extending through the receiver tube without engaging the receiver tube so that the engagement mechanism and security bar are laterally moveable due to settling of the structure of which the wall is a part. An optional slide mechanism (22) is operable by an external operator (120), such as a thermal sensor, smoke detector or wireless receiver, to operate the latch mechanism (24).

21 Claims, 11 Drawing Sheets

SECURITY BAR RELEASE MECHANISM

CROSS-REFERENCED TO RELATED APPLICATION

This application is a Section 371 application based on International Application No. PCT/US00/12054 filed May 2, 2000, and published as WO 00/73607A1 on Dec. 7, 2000 in English, which in turn claims priority of U.S. Provisional Application No. 60/136,486 filed May 28, 1999.

BACKGROUND OF THE INVENTION

This invention relates to release mechanisms for security bars, and particularly to release mechanisms that permit the security bar to be opened from the inside of the building and permit slight shifting of the security bar with respect to the wall to which it is mounted due to structural settlement.

In recent years, there has been increased concern over security of persons and property. One result of this concern is the increased use of security bars or grills over openings, such as windows and doors of dwellings and other buildings. In typical installations, security bars are mounted directly to the exterior wall surface of the building and serve to prevent entry through the opening.

There is increasing concern that the security bars also prevent emergency exit through the opening, such as in the event of fire. For this reason, releasable security bars have been developed permitting the occupant to quickly release the bar from the window in the event of an emergency. These quick release mechanisms usually employ rods that are attached to the security bar and extend through shaft openings in the wall of the building to be locked inside the building. The occupant, desiring to escape through the window, unlocks the rod to push away the security bar. The security bar may be hinged to the building so that it may be swung away from the opening when the release mechanism is unlocked.

One problem associated with prior quick release mechanisms concerns structural settlement. More particularly, building settlement due to normal settlement, seismic activity and other causes, caused misalignment of the security bars to the building structure. Consequently, the force necessary to operate the release mechanism increased, rendering it difficult to release the security bar in case of emergency. Accordingly, there is a need for a quick-release mechanism for a security bar that is not affected by structural settling.

Another problem with prior release mechanisms is that they could not be opened from the outside by rescuers and other emergency personnel. Instead, prior release mechanisms required operation by the occupant inside the structure to release the security bar. If the occupant was incapacitated, it was not possible for rescuers tom easily remove the security bars. Accordingly, there is a need for a security bar release mechanism that automatically releases the security bars in the event of emergency conditions, thereby permitting rescuers to open the security bar from the outside of the structure.

Another problem of prior release mechanisms is that many such mechanisms required removal of pins or turning of latches to operate which confused users during emergency conditions. There is a need, therefore, for a release mechanism that is simple to operate during emergency conditions.

SUMMARY OF THE INVENTION

According to the present invention, a lock mechanism releasably locks a security bar over an opening through a wall, adjacent an outside surface of the wall. Broadly, the lock mechanism includes a housing for mounting to the wall adjacent the opening. An engagement mechanism is coupled to the security bar. A keeper member in the housing is movable to selectively engage a lock surface on the engagement mechanism to restrain the engagement mechanism from movement relative to the housing; the engagement mechanism being allowed to move unrestrained relative to the housing when the keeper member does not engage the lock surface. A manually-operable latch mechanism in the housing moves the keeper member out of engagement with the lock surface.

One aspect of the invention resides in a receiver tube forming a passage between the housing and the outside surface of the wall. The engagement mechanism extends through the receiver tube without engaging the receiver tube so that the engagement mechanism is laterally moveable in the receiver tube so that the release mechanism is unaffected by settling of the structure.

More specifically, the lock mechanism releasably locks a security bar over an opening through the wall and adjacent a first surface of the wall. The housing is mounted in the wall adjacent the opening such that respective portions of the housing are exposed to the opposite first and second surfaces. The engagement mechanism includes a cable having a first end for connection to the security bar and a second end connected to a receiver. The receiver has a lock surface. A plunger extends from the housing through the second surface of the wall and includes a cam surface having first and second portions. The keeper includes a roller in the housing engaging the cam surface on the plunger. The keeper is movable from a first position to a second position when the plunger has moved to an unlock position. When in the first position, the roller engages the first portion of the cam surface which forces the roller into engagement with the lock surface of the receiver so that relative movement between the housing and receiver is restrained. When in the second position, the roller engages the second portion of the cam surface which permits disengagement from the lock surface of the receiver so that the receiver and cable are free to move relative to the housing. A bias spring biases the plunger to a lock position in which the keeper engages the first portion of the cam surface so that the roller engages the lock surface of the receiver and the security bar is locked over the opening in the wall. Operation of the plunger to the unlock position moves the roller to its second position to unlock the security bar from the opening in the wall.

In one form of the lock mechanism, the housing includes a cage, and the roller comprises a rod supported within the cage so that when the plunger is in its lock position, the first cam portion on the plunger engages the rod to sandwich the rod between the cage and the lock surface. When the plunger is in its unlock position, the rod is biased by the cage into the second receiver portion on the plunger free of the lock surface on the receiver.

In another form of the lock mechanism, a slide is supported by the housing and has a surface for engaging the plunger. The slide is movable to operate the plunger to move the keeper from its first to its second position. A second bias spring biases the slide to operate the plunger, and a removable restraint engages the slide to restrain the slide from operating the plunger. An external actuator is operable to remove the restraint from engagement with the slide so that the slide operates the plunger to move the keeper to its second position. In various forms, the external operator may be a smoke detector, a heat detector and/or a radio receiver operated by remote control from an authorized source, such as a fire station.

DETAILED DESCRIPTION OF THE ILLUSTRATIVE EMBODIMENTS

Figure 1:
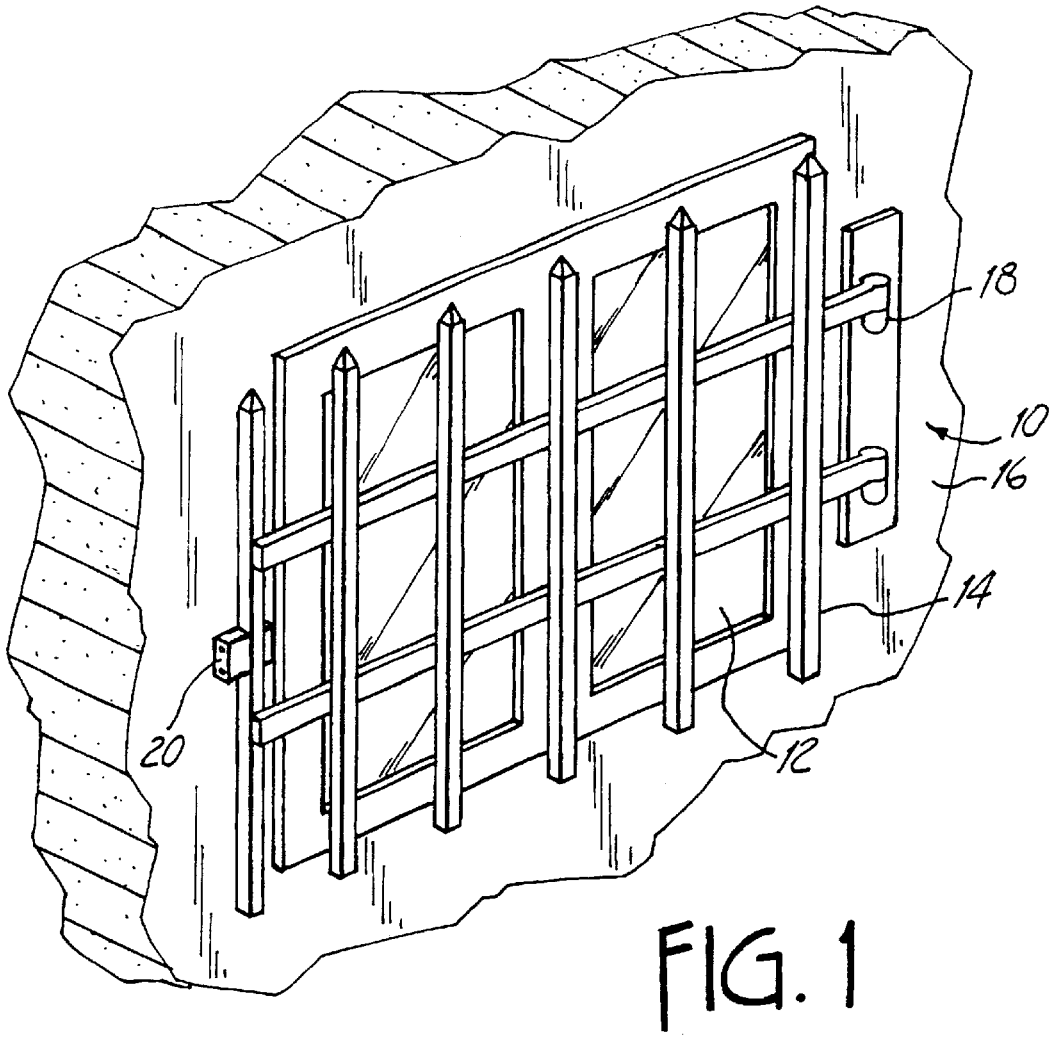
FIG. 1 is a perspective view of a security bar having a release mechanism in accordance with the presently preferred embodiment of the present invention.

FIG. 1 illustrates the environment of the present invention and shows a wall 10 of a building having an opening, such as a window 12, with a security bar or grill 14 mounted to an outside surface 16 of wall 10. Window 12 slides between open and closed positions for ventilation purposes, as well as to provide an emergency route for entry and exit. Security bar 14 is mounted by hinges 18 to the surface 16 of the wall and is latched by a single release mechanism 20 according to the present invention. Release mechanism 20 is connected to the security bar opposite hinges 18 so that upon release of mechanism 20, security bar 14 may swing aside on hinges 18 to allow emergency exit or entry to the building. In some installations it might be preferred to eliminate hinges 18 and connect security bar 14 to the wall employing two or more release mechanisms 20 according to the invention.

Release mechanism 20 is illustrated in greater detail in FIGS. 2–5 and is best described with reference to FIGS. 2, 3 and 3A–3C, simultaneously. The release mechanism comprises a latch mechanism 24, a keeper mechanism 26 and an engagement mechanism 28, and an optional slide mechanism 22. When in the locked position, latch mechanism 24 operates keeper mechanism 26 to engage engagement mechanism 28 which is attached to the security bar. The lock mechanism is movable between a locked and an unlocked position so that keeper mechanism 26 selectively engages engagement mechanism 28 to lock or release the security bar, as the case may be. As described in connection with FIGS. 5–9, optional slide mechanism 22 is operated by an optional external operator to operate the latch mechanism. Slide mechanism 22 is also employed as part of a fail-safe feature of the actuator illustrated in FIGS. 10–13.

Slide mechanism 22 includes a slide housing having top and bottom housing members 30 and 32. Slide bar 34 is received in slide channel 36 formed between the two housing members. Pin 38 extends through an aperture in slide 34 for attachment to an end of tension springs 40 and 42, nested in respective spring channels 44 in housing members 30 and 32. Bracket 46 is mounted to top housing member 30. The opposite ends of tension springs 40 and 42 are attached to bracket 46. Slide 34 includes a rear surface 48 to engage pin 52 to operate latch mechanism 24.

Latch mechanism 24 includes a slide plunger 50 having stop pin 52 mounted to an upper surface and extending through slot 54 in housing member 32 to engage surface 48 of slider 34. Pin 52 within slot 54 also defines a limit of travel for plunger 50. Compression spring 56 is received in a receiver aperture 51 in plunger 50 (FIG. 2) and is held in place on bracket 46 by protrusion 58. Plunger 50 includes a cam surface having first and second cam portions 53 and 55, respectively. Portion 53 is closer to the bottom surface of the plunger than portion 55.

Figure 2:
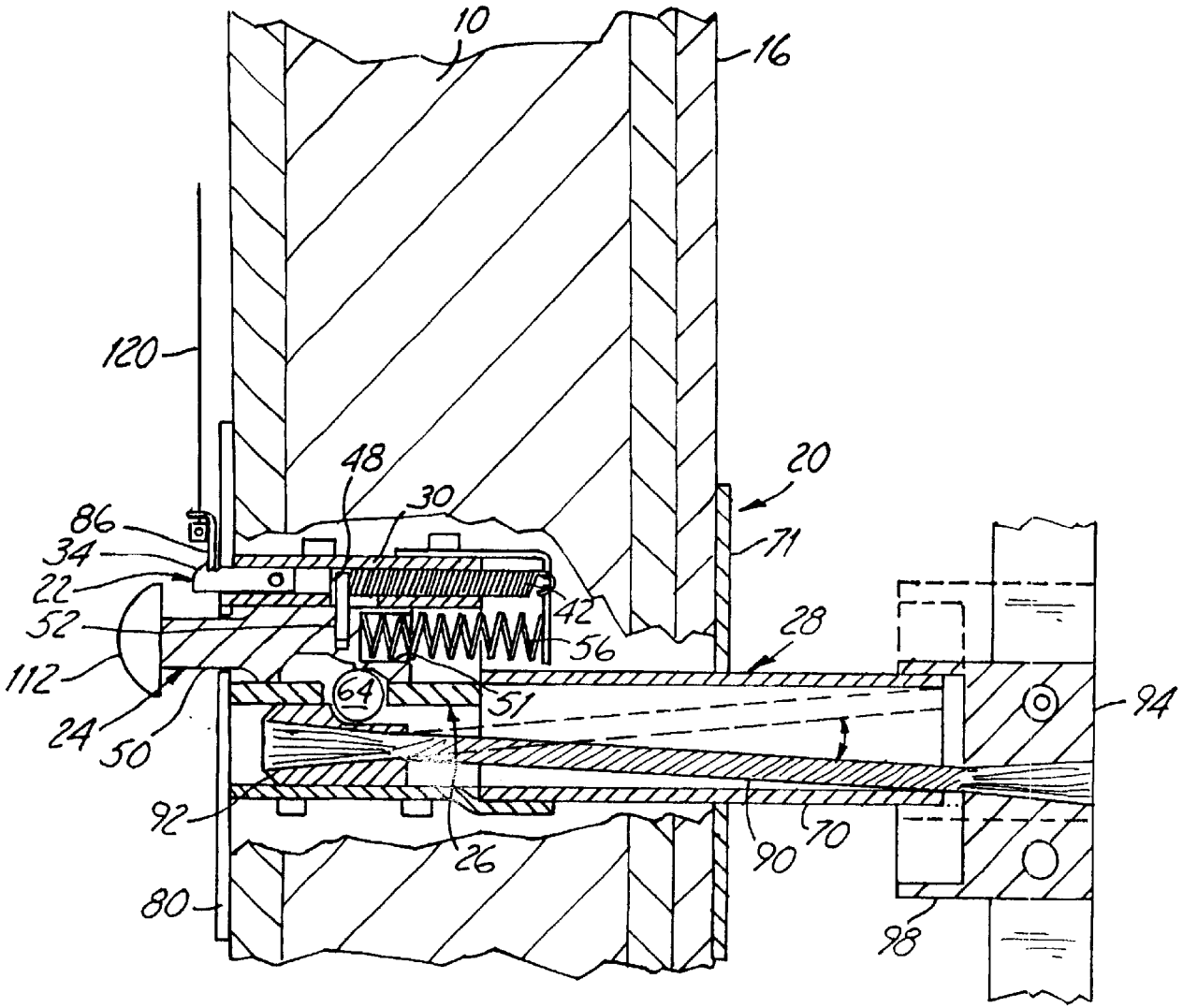
FIG. 2 is a section view through a wall of the building illustrating details of the security bar release mechanism according to the present invention.

Keeper mechanism 26 comprises a pair of side plates 60 having recesses 62 formed on the facing surfaces thereof. Keeper rod 64 is received in recesses 62 and plates 66 are pinned to the plates 60 on each side of keeper rod 64 to form a cage for rod 64. Bottom plate 68 is fastened to plates 60 to hold keeper assembly 26 together. Receiver tube 70 is fastened to plate 68 and extends through wall 10 past surface 16 to a position adjacent security bar 14 (FIG. 2). External face plate 71 is fastened to the external surface 16 of wall 10 to protect the wall from external environments.

Figures 3, 3A:
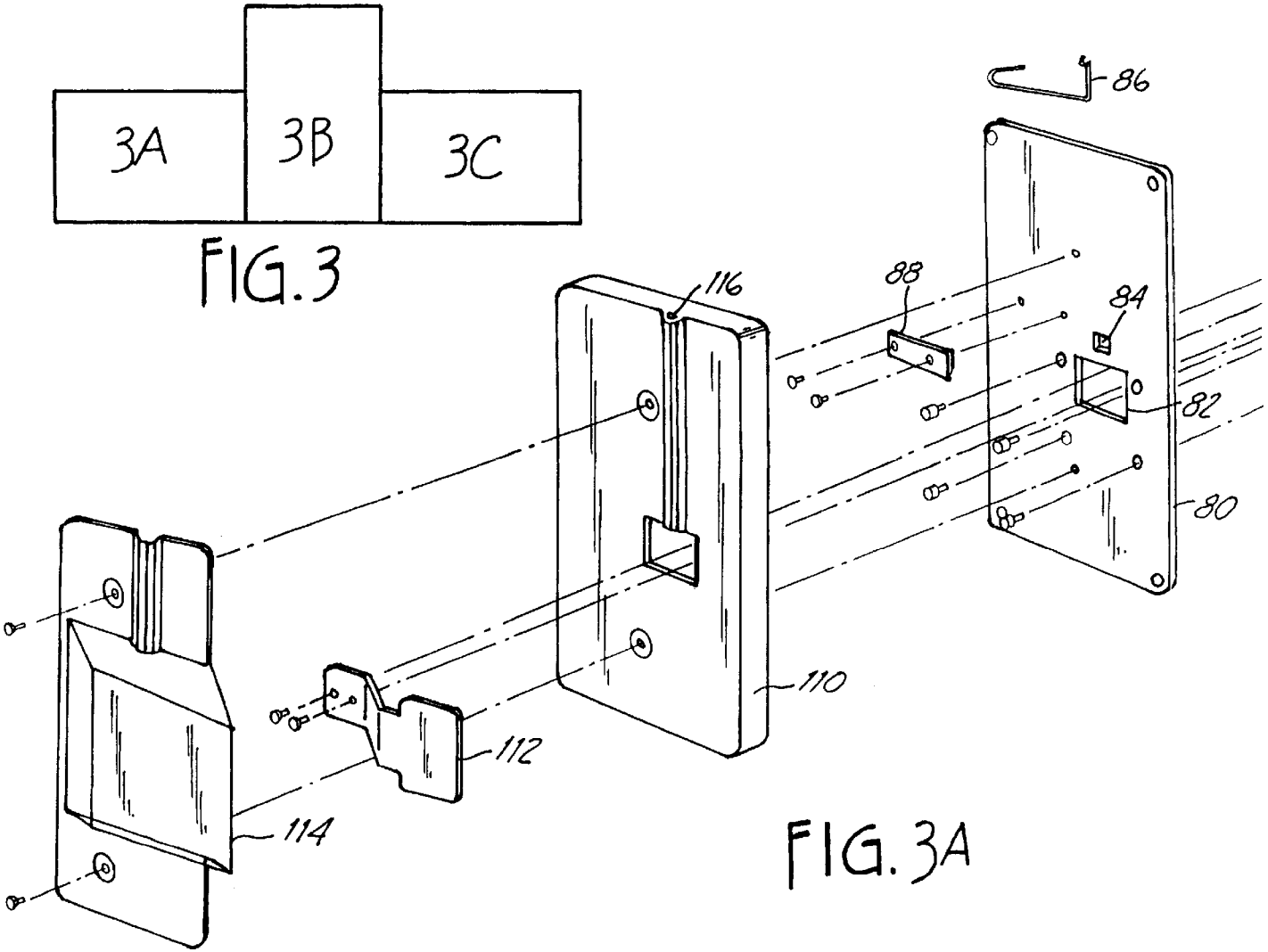
FIGS. 3A–3C, when edge matches as illustrated in FIG. 3, is an exploded perspective view of the security bar release mechanism illustrated in FIG. 2.
Figure 3B:
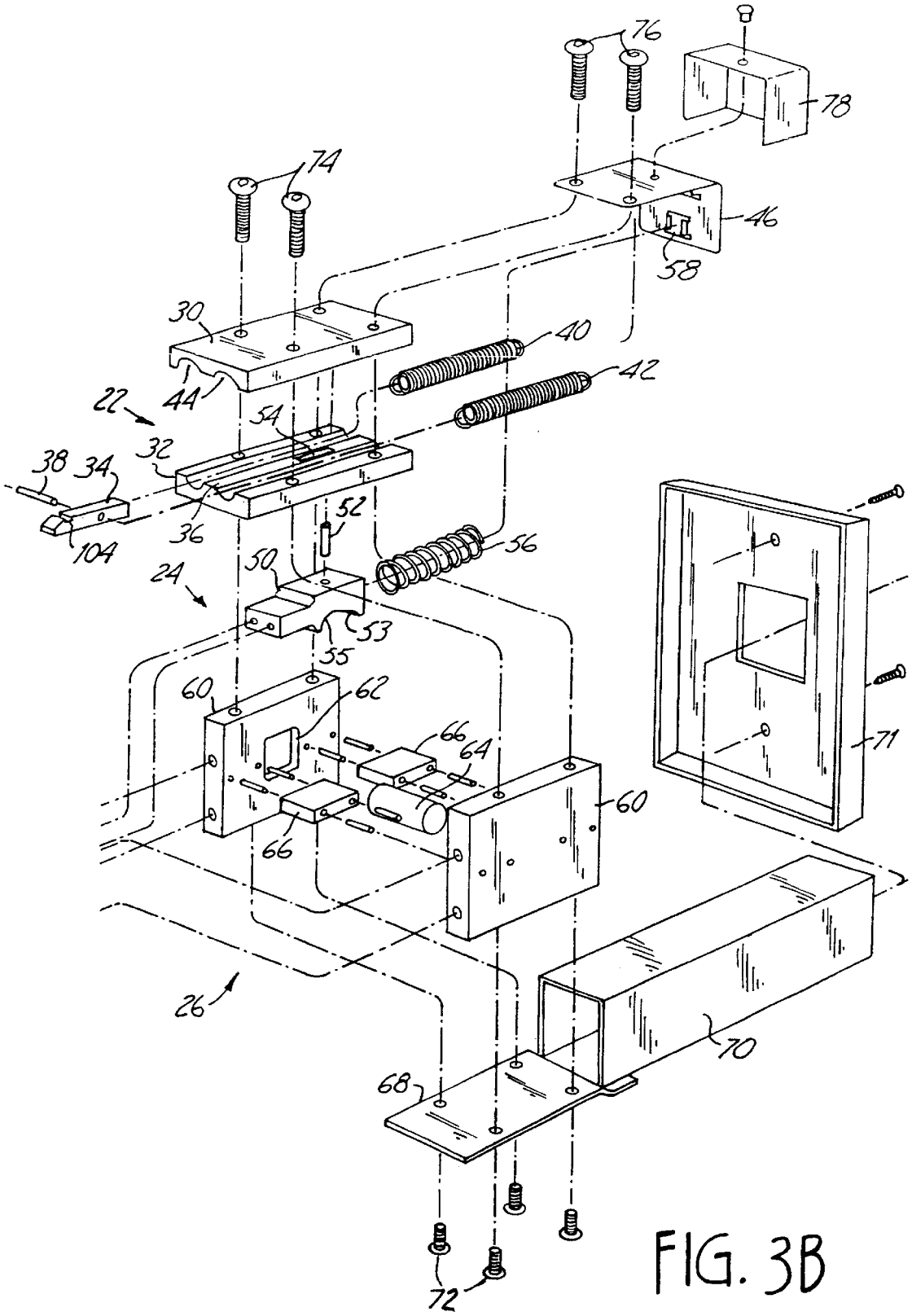
Figure 3C:
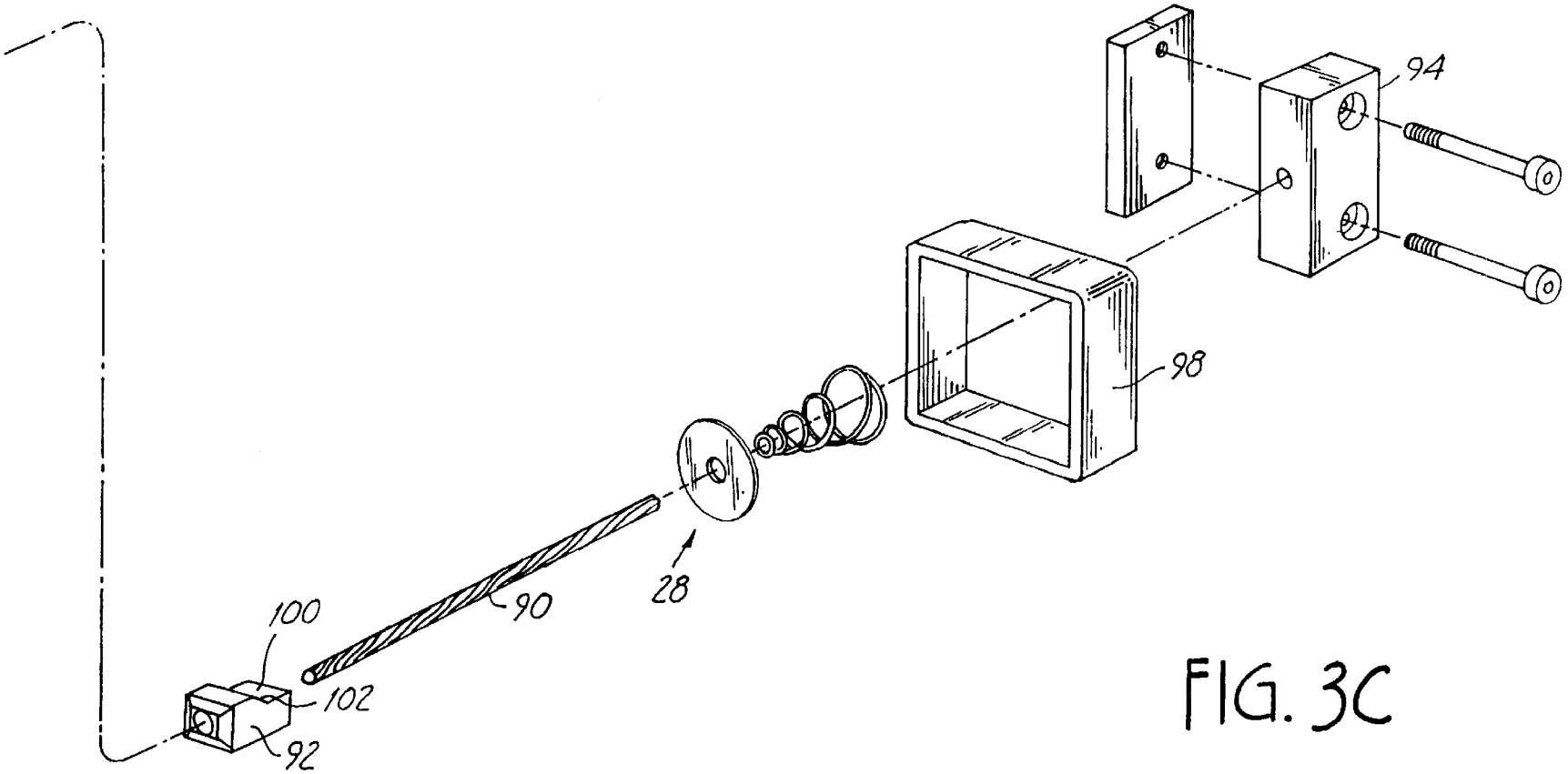

The unit is assembled by assembling keeper mechanism 26 and fastening it to bottom plate 68 with fasteners 72. Plunger 50, with its stop pin 52, is positioned on the top surfaces of plate 66 so that keeper rod 64 is received in the slot of cam portions 53 and 55 (FIG. 2). Housing members 30 and 32 are clamped together, and fasteners 74 are loosely fastened to position housing members 30 and 32 to plates 60. Springs 40 and 42 are fastened to pin 38 of slider 34 and the entire assembly is assembled into the respective slides in the housing formed by members 30 and 32 until springs 40 and 42 protrude from the rear thereof. The free ends of springs 40 and 42 are fastened to bracket 46 which is then fastened to portions 30 and 32 and plates 60 by fasteners 76. At the same time, compression spring 56 is loaded into aperture 51 in plunger 50 and retained by protrusion 58 on bracket 46. The fasteners are then tightened, and a dust guard 78 is fastened to bracket 46. Front plate 80 is fastened to plates 60 such that a forward portion of plunger 50 extends through aperture 82 and a forward portion of slide 34 extends through aperture 84. Wire form 86 is mounted by keeper plate 88 to the front surface of plate 80. A natural bias spring action of wire form 86 biases the body of the wire form downwardly into slot 104 on slider 34 (FIG. 3B).

Springs 40 and 42 are tension springs that bias slider 34 rearwardly, or to the right in FIGS. 2–5. Spring 56 is a compression spring biasing plunger 50 forwardly, or the left in FIGS. 2–5. Preferably, the combined action of springs 40 and 42 exerts approximately ten pounds of force on slider 34, whereas spring 56 exerts approximately two pounds of force on plunger 50. In the condition thus far described, the tension of springs 40 and 42 urges slide 34 to engage pin 52 on plunger 50, thereby operating against compression spring 56 so that roller 64 is received in the cam portion 55.

The unit is installed in a cavity in wall 10 that is open to the interior of the building, with the housing formed by slide housing members 30 and 32, plates 60 and 66 of the keeper mechanism, bottom plate 68 and brackets 46 and 78 in the cavity. Front plate 80 closes the cavity on the interior surface of wall 10. Conveniently, the housing is mounted to the wall by fastening front plate 80 to structural studs (not shown) in wall 10.

Engagement mechanism 28 includes a flexible steel cable 90 having one end attached to a receiver 92 and the opposite end to a portion of an attachment block 94, attached to security bar 14. Guard 98 is attached to the completed receiver block, as illustrated in FIG. 2, and the free end of receiver tube 70 is loosely received in guard 98. As illustrated particularly in FIG. 2, receiver 92 includes an area of reduced section 100 defining a lock surface 102 arranged to engage keeper rod 64.

To set the device, slider 34 is pulled outwardly, toward the front or left in FIGS. 2–5, against the force of springs 40 and 42. When slider 34 is extracted to its locked position, wire form 86 is biased into slot 104 of slider 34 to retain slider 34 in the locked position. Compression spring 56 biases plunger 50 outwardly, toward the front or left in FIGS. 2–5 toward the locked position of the plunger. Cable 90 and receiver 92 are assembled to the unit by holding plunger 50 in its inward or unlocked position and sliding cable 90 and receiver 92 through tube 70, onto plate 68 and past the opening between plates 66. The chamfered forward edge of receiver 92 forces rod 64 against the forward plate 66 and upwardly into cam portion 55, permitting the receiver to be fully inserted. Plunger 50 is then released, allowing spring 56 to urge the plunger outward, to the front or left in FIGS. 2–5, thereby locking keeper rod 64 in cam portion 53 and against wall 102 of the receiver. The assembly of the security bar 14 is then completed with a slight tension being imposed on cable 90.

Face plate 110 is fastened over front plate 80 so that the end of plunger 50 extends therethrough, and actuator 112 is fastened to the free end of plunger 50. As shown particularly in FIG. 3, face plate 110 includes a channel 116 for receiving an actuator wire of an optional operator. Preferably, a guard 114 is fastened over face plate 110 to protect actuator 112 from accidental operation. Guard 114 also serves to prevent an intruder from attempting to operate the release mechanism by breaking the window glass and reaching through the security bar opening and broken window.

In the operation of the apparatus, when plunger 50 is in the locked position illustrated in FIG. 2, keeper rod 64 is nested in cam portion 53 to be sandwiched between the rearward plate 66 of the cage and surface 102 of receiver 92. Hence, the receiver is prevented from being withdrawn from the unit and security bar 14 is retained in a locked position by virtue of cable 90 and receiver 92.

Figure 4:
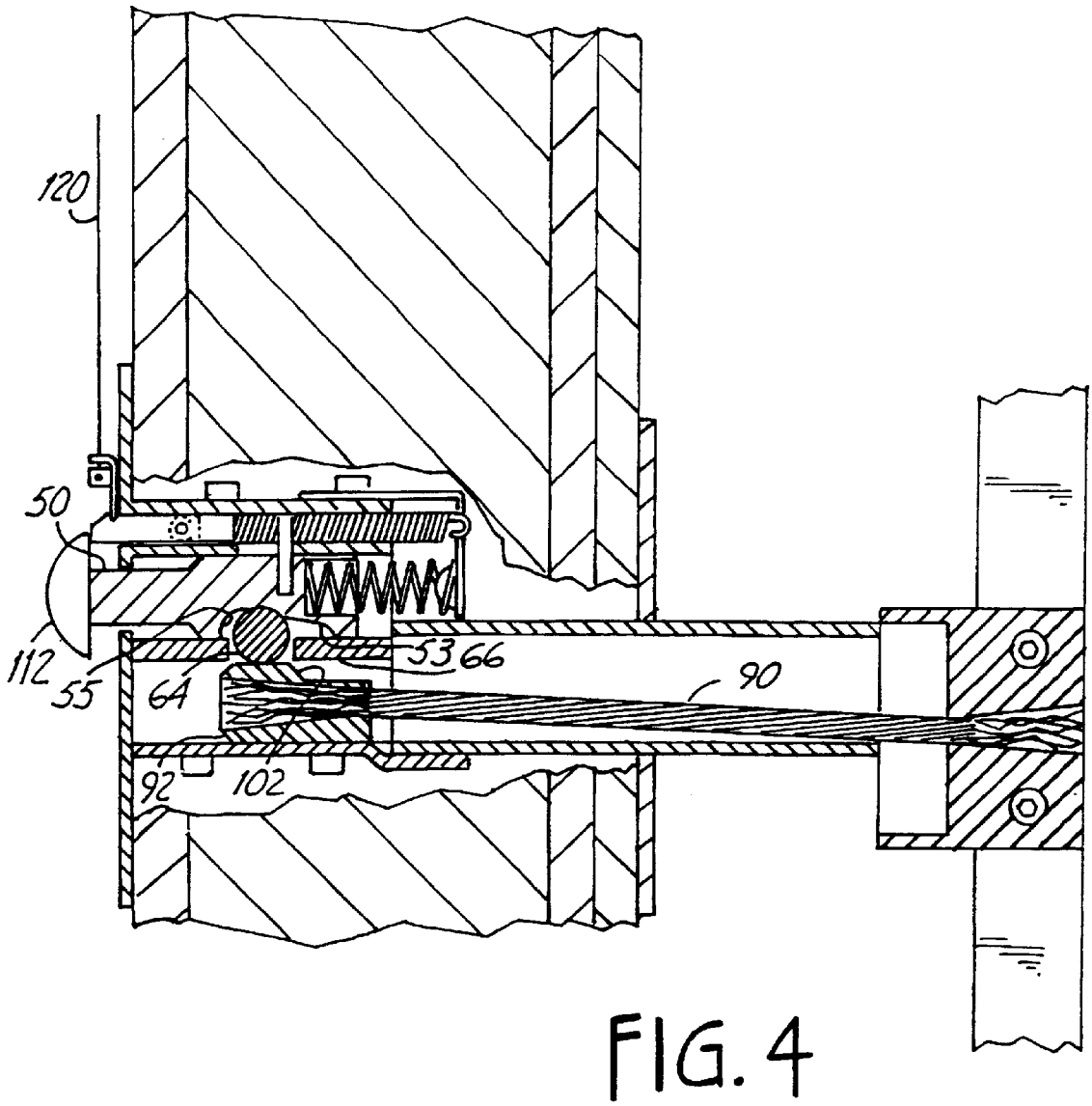
FIGS. 4 and 5 are section views, as in FIG. 2, illustrating the security bar release mechanism in an actuated or released condition due to occupant actuation (FIG. 4) or an emergency condition (FIG. 5).

In the event of an emergency, the occupant may operate plunger 50 by depressing actuator 112, moving the plunger to the right in FIG. 4, permitting keeper rod 64 to move into the second cam portion 55. The lock wall 102 on receiver 92 is sloped so that as the deeper space of cam portion 55 confronts the rod, the rearward plate 66 forces rod 64 against wall 102. The tension in cable 90 pulls receiver 92 outwardly, forcing rod into cam portion 55 to disengage from lock surface 102 on receiver 92. Receiver 92 is now free to be withdrawn through tube 70 since rod 64 no longer engages surface 102. As a result, the security bar is unlocked, and free to be opened.

Figure 5:
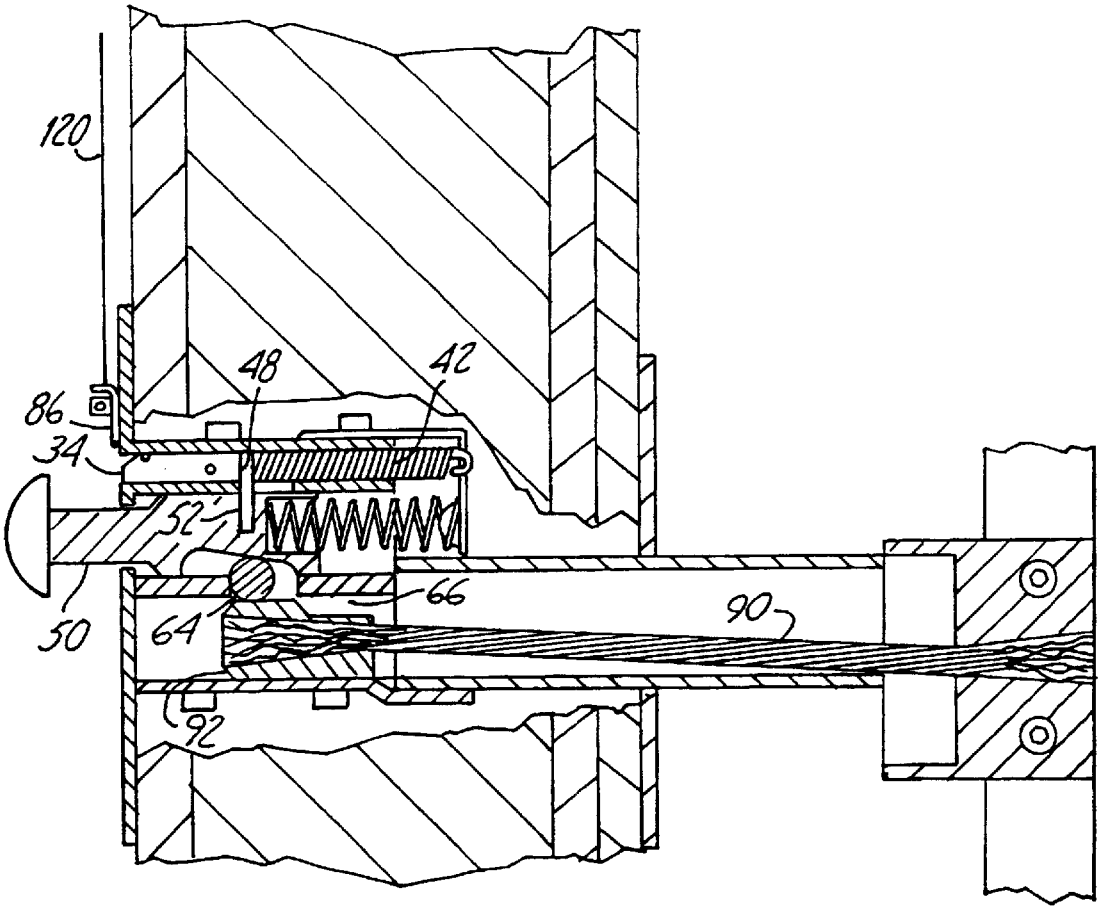
Figure 6:
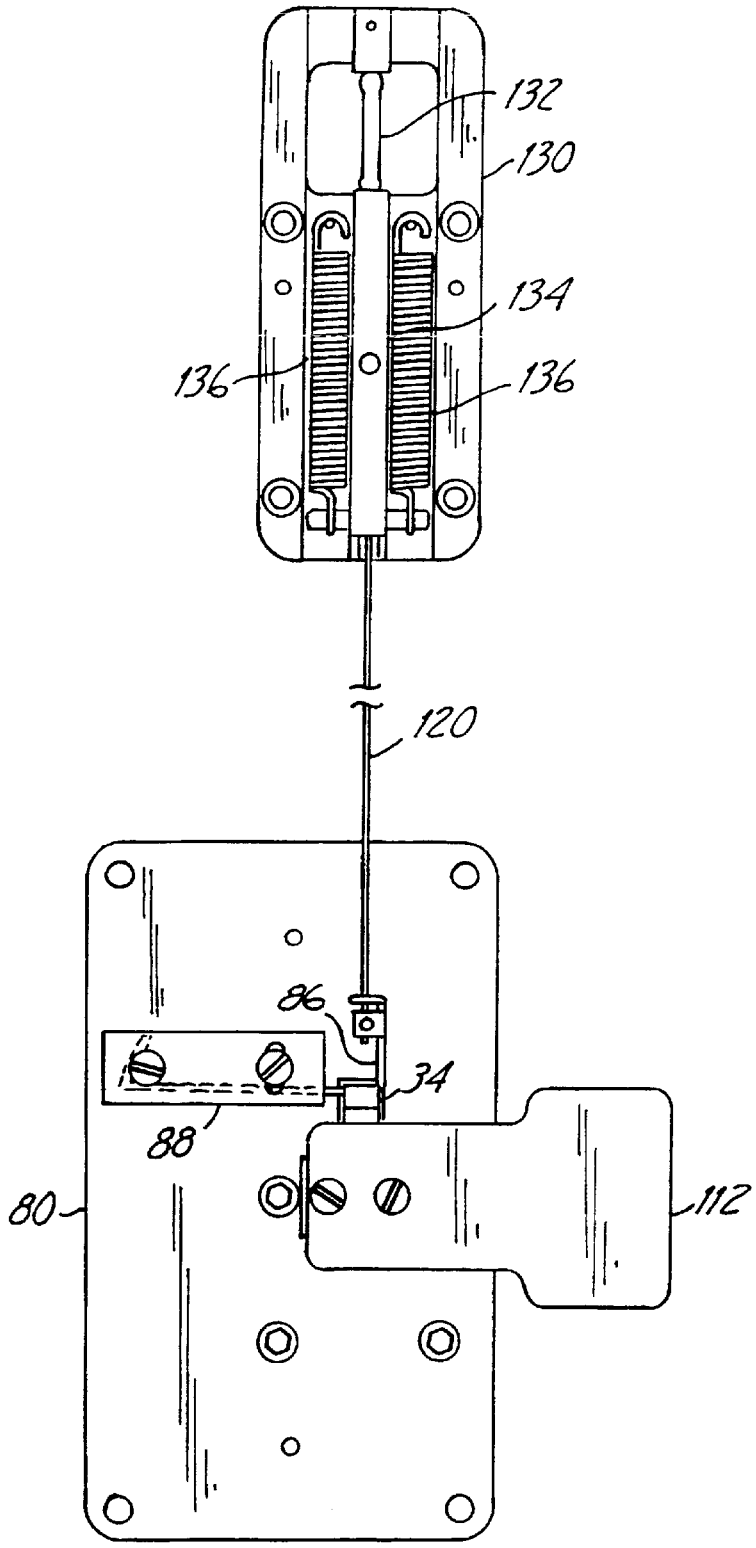
FIGS. 6 and 7 are plan views illustrating an optional temperature actuated operator for the security bar release mechanism illustrated in FIG. 2.
Figure 7:
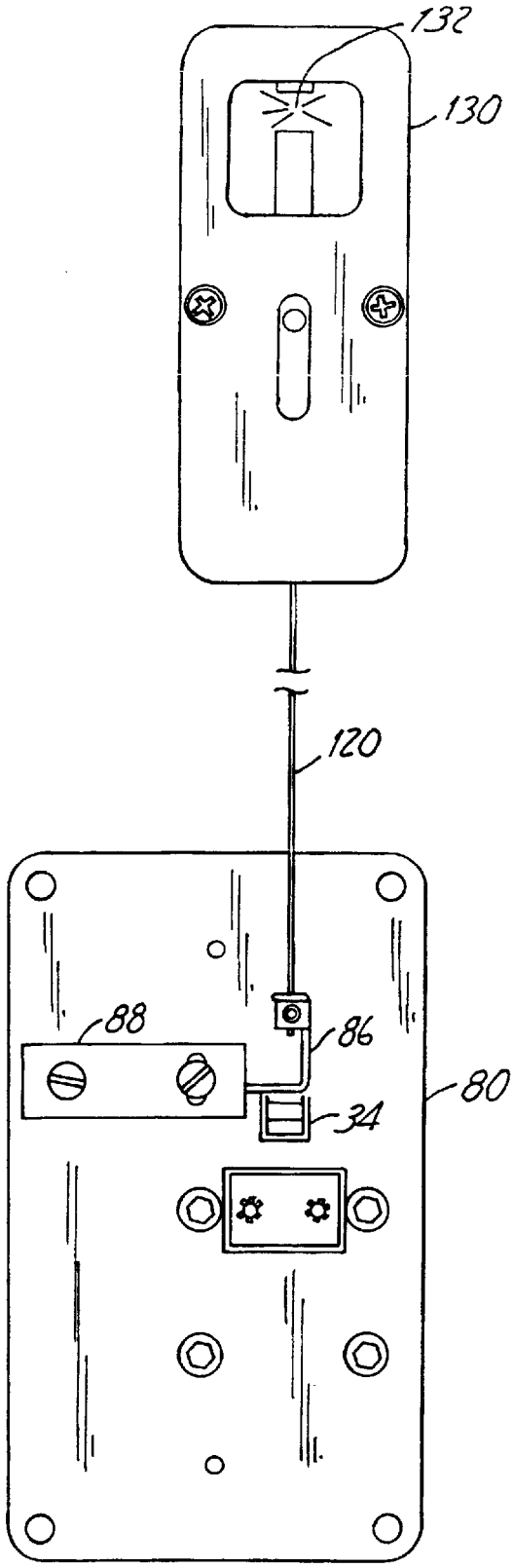

The mechanism can also be operated by an external operator, as illustrated in FIG. 5. Operation of wire 120 to pull up on wire form 86 unlocks slide 34 permitting springs 40 and 42 to pull slide 34 to the right as illustrated in the drawings. When rear surface 48 of slide 34 engages pin 52, plunger 50 is also pulled to the right, thereby moving the plunger to its unlocked position, allowing the security bar to be removed. The external operator may be a thermal operator, as illustrated in FIGS. 6 and 7, employed to operate wire 120 to operate the release mechanism. The thermal operator includes housing 130 having a thermal bulb 132 that is arranged to break upon reaching a predetermined temperature. Bulb 132 is held in compression between housing 130 and rod 134 by springs 136. Wire 120 is attached to rod 134. Housing 130 is mounted near the ceiling of the room above the window protected by the security bar such that should a fire condition be sensed and bulb 132 broken, rod 134 is pulled upwardly by springs 136, thereby operating wire 120 to pull wire form 86 out of slot 104 in slide 34. As a result, slide 34 operates plunger 50 to release the security bar, as previously described.

One feature of the remote operator illustrated in FIGS. 6 and 7 for operating the device of FIGS. 2–5 is that security bar may be released without occupant action. More particularly, the security bar is released upon a high temperature, indicative of a fire, within the room. By releasing the security bar automatically, rescuers outside the building may open the security bars and window without occupant assistance, thereby enabling rescue of a disabled occupant.

Figure 8:
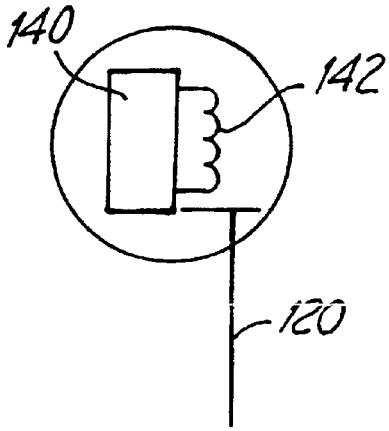
FIGS. 8 and 9 illustrate optional smoke detector and remote control operations for operating the security bar release mechanism illustrated in FIG. 2.
Figure 9:
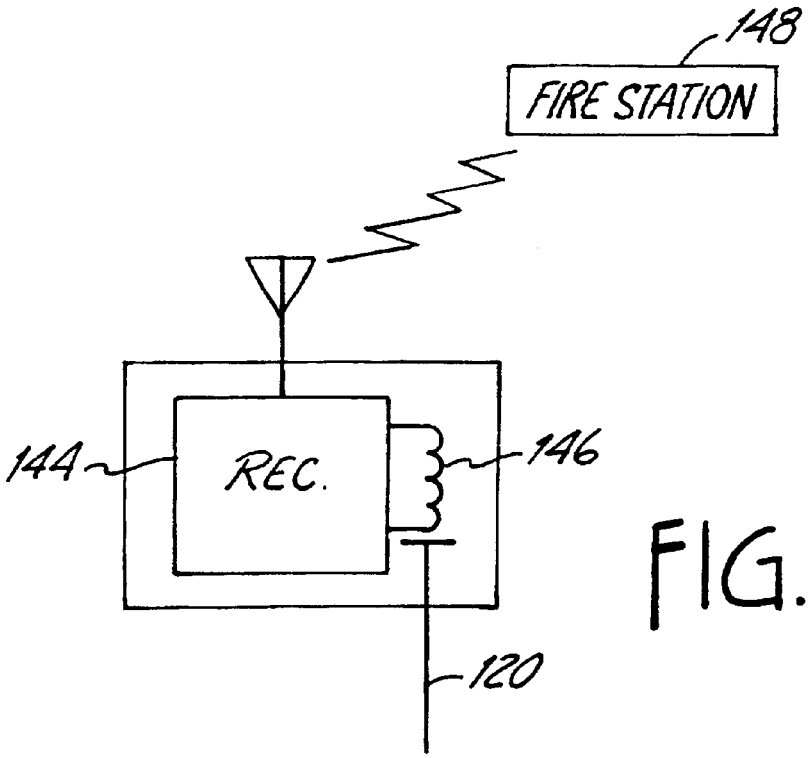
Figure 10:
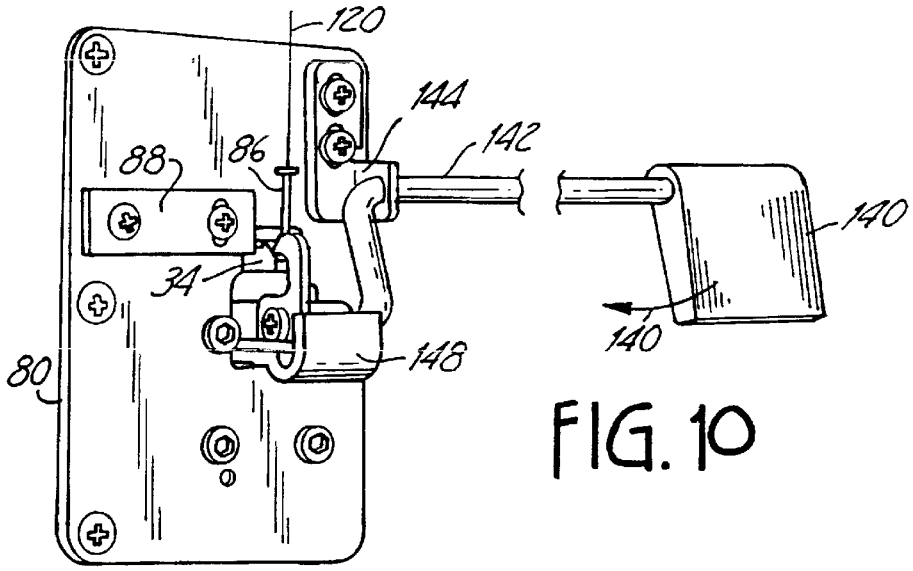
FIG. 10 is a perspective view.

FIGS. 8 and 9 illustrate other optional external operators for the invention. In FIG. 8, a smoke detector 140 operates a solenoid 142 which in turn operates wire 120 as previously described. In FIG. 9, a radio receiver 144 operates solenoid 146 to operate wire 120. Receiver 144 receives wireless coded signals from a remote station, such as fire station 148. Clearly, other types of external operators may be employed to operate the release mechanism without departing from the spirit and scope of the present invention.

FIGS. 10–13 illustrate a modification of the manual actuator mechanism for operating the release mechanism of the present invention. The actuator mechanism includes actuator 140 mounted to rod 142 which, in turn, is hinged to bracket 144 mounted to the front surface of face plate 80. Arm 146 of rod 142 is nested within catch 148 on plunger 50 so that upon depressing actuator 140 in the direction of arrow 141, rod 142 rotates in the hinge formed by racket 144. Arm 146 swings toward face plate 80 to carry catch 148 and actuate plunger 50 to its unlocked position, releasing the security bar, as previously described.

Figure 11:
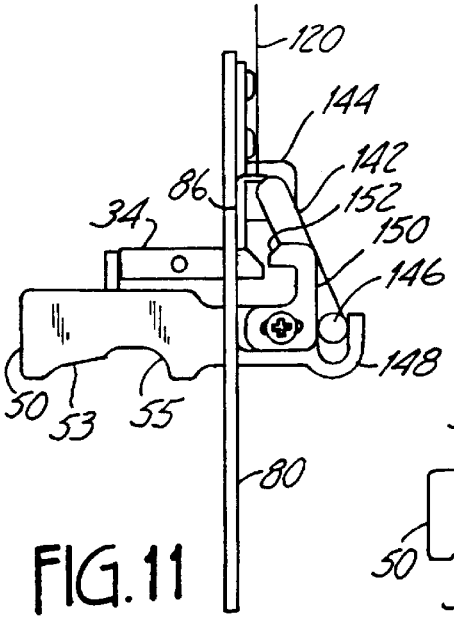
FIGS. 11–13 are side views, of a preferred actuator for the release mechanism.
Figure 12:
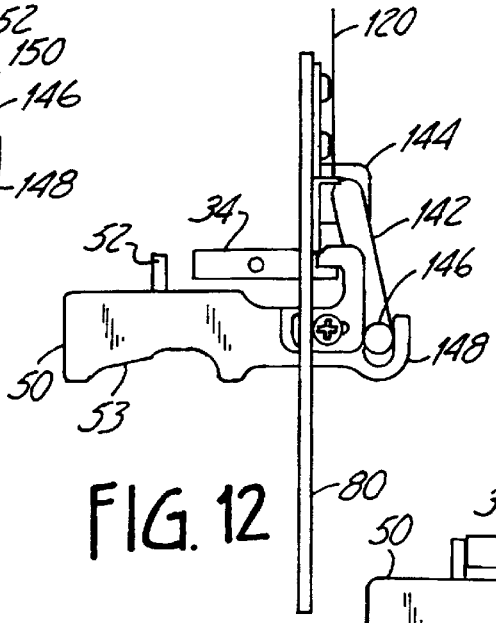
Figure 13:
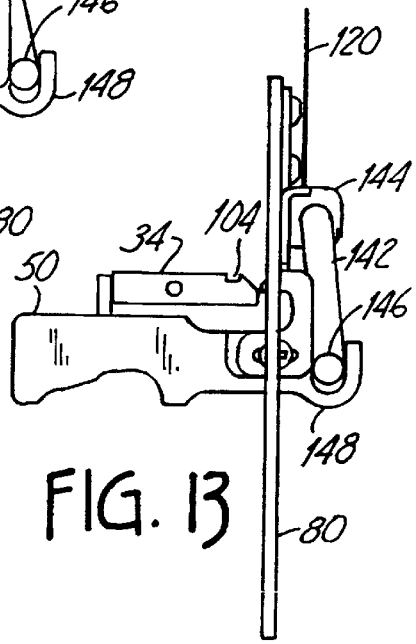

Cam member 150 is mounted to plunger 50 and includes a cam surface 152 that engages wire form 86 as plunger moves from the position illustrated in FIG. 11 to that illustrated in FIG. 12. As shown in FIG. 13, further movement of plunger 50 and cam 150 forces wire form 86 out of engagement with slot 104 in slide 34. Slide 34 is pulled by springs 40 and 42 (FIG. 3B) to the actuated position, thereby engaging pin 52 to hold plunger 50 and slider 34 in their actuated position. This ensures that the release mechanism will not inadvertently re-lock in the event that insufficient tension exists on cable 90 to remove receiver 92 from keeper mechanism 26.

The actuator mechanism of FIGS. 10–13 provides a fail-safe mechanism to ensure that the release mechanism remains released once actuated. Additionally, while the drawings illustrate the structure of the actuator mechanism, it is preferred that the mechanism be enclosed in a housing to prevent accidental operation. Moreover, employing a rod 142 of extended length, such as one meter more, actuator 140 may be positioned away from the window, ensuring that an intruder could not break the window and reach inside the building to operate the actuator.

The present invention thus provides a quick release for a security bar to enable an occupant to release the lock mechanism locking the security bar in place to permit easy escape from the building. The lock mechanism attaches the security bar to the building without the use of rigid connections that might become impeded, as the building settles.

External operators may be employed to release the security bar upon an emergency condition or upon radio actuation by authorized persons. While the invention is described using a single optional external operator, plural such operators may be employed such that any one operator may remove wire form 86. If no optional external operator is employed, slide mechanisms 22 may be omitted or included for future addition of an external operator, as desired.

Although the present invention has been described with reference to preferred embodiments, workers skilled in the art will recognize that changes may be made in form and detail without departing from the spirit and scope of the invention.

What is claimed is:

1. A lock mechanism for releasably locking a security bar over an opening through a wall and adjacent a surface of the wall, the lock mechanism including:

a housing for mounting to the wall adjacent the opening;

an engagement mechanism for coupling to the security bar, the engagement mechanism including a lock surface;

a keeper member mounted within the housing, the keeper member including a roller moveable between a first position in the housing engaging the lock surface to restrain the engagement mechanism from movement relative to the housing and a second position in the housing out of engagement with the lock surface to allow the engagement mechanism to move unrestrained relative to the housing; and a manually-operable latch mechanism in the housing operable to move the keeper member between its first and second positions.

2. The lock mechanism of claim 1, wherein the engagement mechanism includes:

a cable having first and second ends, the first end for connection to the security bar, and a receiver connected to the second end of the cable, the lock surface being on the receiver to engage the keeper member to restrain the receiver in the housing so that a security bar connected to the cable is locked adjacent the wall by a distance from the receiver based on a length of the cable between its first and second ends.

3. The lock mechanism of claim 2, wherein the cable is flexible so that the security bar connected to the cable is movable lateral to the surface of the wall when the keeper member engages the lock surface.

4. The lock mechanism of claim 2, wherein the engagement mechanism further includes a tube coupled to the housing and extending through the surface of the wall to define a longitudinal passage, the cable extending through the passage without restriction by the tube so that the cable is laterally movable within the tube.

5. The lock mechanism of claim 2, including a slide supported by the housing and having a surface for engaging the latch mechanism, the slide being movable from a first to a second position to operate the latch mechanism to move the keeper member from its first to its second position, a second bias member biasing the slide to its second position, and a restraint normally engaging the slide to retain the slide in its first position, the restraint being removable to permit the slide to move to its second position.

6. The lock mechanism of claim 5, wherein the keeper member includes a cam operator arranged to disengage the restraint from the slide when the keeper member is in its second position.

7. The lock mechanism of claim 1, wherein the keeper member includes a roller moveable from a first position to engage the lock surface of the engagement mechanism, to a second position not engaging the lock surface of the engagement mechanism, and the latch mechanism includes a plunger having a cam surface engaging the roller, the cam surface having a first portion in which the cam surface engages the roller into engagement with the lock surface of the engagement mechanism and a second portion in which the cam surface engages the roller out of engagement with the lock surface of the engagement mechanism, and a bias member biasing the plunger to a position in which the first portion of the cam surface engages the roller.

8. The lock mechanism of claim 7, including an operator connected to the plunger adjacent a second surface of the wall opposite the first-named surface to move the plunger so that the second portion of the cam surface engages the roller.

9. The lock mechanism of claim 7, wherein the keeper member further includes a cage within the housing and the roller comprises a rod coupled to the cage for rotation about an axis parallel to the lock surface.

10. The lock mechanism of claim 1, wherein the keeper member further includes a cage within the housing and the roller comprises a rod coupled to the cage for rotation about an axis parallel to the lock surface.

11. The lock mechanism of claim 1, including a slide supported by the housing and having a surface for engaging the latch mechanism, the slide being movable from a first to a second position to operate the latch mechanism to move the keeper member from its first to its second position, a slide bias member biasing the slide to its second position, and a restraint normally engaging the slide to retain the slide in its first position, the restraint being removable to permit the slide to move to its second position.

12. The lock mechanism of claim 11, including an external operator for disengaging the restraint from the slide, whereby the security bar is unlocked upon operation of the external operator.

13. The lock mechanism of claim 12, wherein the external operator is selected from the group consisting of a smoke detector, a heat detector and a radio receiver.

14. A lock mechanism for releasably locking a security bar over an opening through a wall and adjacent a first surface of the wall, the lock mechanism including:

a housing for mounting in the wall adjacent the opening such that respective portions of the housing are exposed to the first surface and a second surface opposite the first surface;

an engagement mechanism including a cable having a first end for connection to the security bar and a second end, and a receiver connected to the second end of the cable, the receiver having a lock surface;

a roller in the housing;

a plunger operable to move from a lock position to an unlock position, the plunger having a cam surface engaging the roller, the cam surface having first and second portions, the first portion of the cam surface engaging the roller when the plunger is in its lock position so that the roller engages the lock surface on the receiver and relative movement between the housing and receiver is restrained, the second portion of the cam surface engaging the roller when the roller is in its unlock position so that the roller does not engage the lock surface on the receiver and the receiver and cable are free to move relative to the housing;

a bias member biasing the plunger to its lock position;

whereby the security bar is locked over the opening in the wall when the plunger is in its lock position, and operation of the plunger to its unlock position unlocks the security bar from the opening in the wall.

15. The lock mechanism of claim 14, further including an operator coupled to the plunger adjacent the second surface of the wall, the operator being operable to move the plunger from its lock to its unlock position.

16. The lock mechanism of claim 14, wherein the housing includes a cage, and the roller comprises a rod supported within the cage so that when the plunger is in its lock position, the first portion of the cam surface engages the rod to sandwich the rod between the cage and the lock surface, and when the plunger is in its unlock position, the rod is biased by the cage into engagement with the second portion of the cam surface and out of engagement with of the lock surface.

17. The lock mechanism of claim 14, including a slide supported by the housing and having a surface for engaging the plunger, the slide being movable between first and second positions to operate the plunger to move the roller from its first to its second position, a second bias member biasing the slide from its first to its second position, and a restraint normally engaging the slide to retain the slide in its first position, the restraint being removable to permit the slide to move to its second position.

18. The lock mechanism of claim 17, wherein the keeper member includes a cam operator arranged to disengage the restraint from the slide when the keeper member is in its second position.

19. The lock mechanism of claim 17, including an external operator for removing engagement of the restraint from the slide, whereby the security bar is unlocked upon operation of the external operator.

20. The lock mechanism of claim 19, wherein the external operator is selected from the group consisting of a smoke detector, a heat detector and a radio receiver.

21. A lock mechanism for releasably locking a security bar over an opening through a wall and adjacent a surface of the wall, the lock mechanism including:

a housing mounted to the wall adjacent the opening;

a latch in the housing movable from a first to a second position;

a receiver having a lock surface engaging the latch when the latch is in its first position and not engaging the latch when the latch is in its second position;

a receiver tube forming an elongated passage between the housing and the surface of the wall; and an engagement mechanism having a first end coupled to the security bar and a second end coupled to the receiver, the engagement mechanism extending through the receiver tube without restriction by the receiver tube so that the engagement mechanism is laterally movable within the receiver tube and the latch is operable between its first and second positions to selectively engage the receiver without regard to lateral movement of the security bar to the wall.

* * * * *